US005501603A

United States Patent [19]

Mueller et al.

[11] Patent Number: 5,501,603

[45] Date of Patent: Mar. 26, 1996

[54] MODULARIZED VISUAL TRAINING AID FOR CLASSROOM INSTRUCTION

[75] Inventors: Eric J. Mueller, Minneapolis; Gary M. Benting; Leslie R. Abraham, both of Owatonna; Phillip C. Dretzka, Minneapolis, all of Minn.

[73] Assignee: Wenger Corporation, Owatonna, Minn.

[21] Appl. No.: 289,398

[22] Filed: Aug. 12, 1994

[51] Int. Cl.[6] ..... B43L 1/00

[52] U.S. Cl. ..... 434/419; 40/610; 434/408

[58] Field of Search ..... 434/419, 420, 434/429, 408, 419, 408; 248/447, 448; 40/610, 601; 108/8, 6

[56] References Cited

U.S. PATENT DOCUMENTS

| | | | |
|---|---|---|---|
| 641,683 | 1/1900 | Evans | 434/419 |
| 1,652,774 | 12/1927 | Fraser et al. | 434/419 |
| 1,912,096 | 5/1933 | Reuter | 434/419 |
| 2,741,868 | 4/1956 | Saunders | 108/8 |
| 3,148,461 | 9/1964 | Johnson | 434/419 |
| 3,643,935 | 2/1972 | Bell | 108/8 |
| 4,879,954 | 11/1989 | Sawamara et al. | 108/6 |
| 5,208,585 | 5/1993 | Sprague | 40/610 |
| 5,305,114 | 4/1994 | Egashira et al. | 434/419 |

FOREIGN PATENT DOCUMENTS

| | | | |
|---|---|---|---|
| 123448 | 1/1901 | Germany | 434/419 |
| 864 | 6/1886 | Sweden | 434/419 |

*Primary Examiner*—Jessica J. Harrison
*Assistant Examiner*—Michael O'Neill
*Attorney, Agent, or Firm*—Patterson & Keough

[57] ABSTRACT

A modularized visual training aid for classroom instruction including a stabilizing base, upright support operably coupled to the base and extending generally vertically upward from the base for storing teaching tools and a display housing pivotably mounted to the upright support. The display housing includes an expandable vertical display surface for exhibition and application of visual materials and teaching tools and is shiftable between an elevated position and a lowered position to accommodate users of different heights. Storage areas for various teaching tools are provided on the base, on the display housing and within the upright support. In operation, the training aid is moved the presentation location and the display housing pivoted into either an elevated or lowered position to present the expandable vertical display surface to the students. During the lesson, students or the teacher can illustrate points by working on the display surface or viewing lesson placards attached to the display surface.

15 Claims, 6 Drawing Sheets

84
62
70
68
16
84
63
72
42
88
86
74
64
14
48
19
12
20
22
34
10
90
76
70
66
65
63
82
58
54
56
57
30
28
33
18
32
76

10
20
12
22
84
16
40
40
28
33
38
26
36
24
40
40

62
68
66
10
16
82
82
70
78
72
42
50
60
48
56
14
46
19
20
12
40
22
40

MODULARIZED VISUAL TRAINING AID FOR CLASSROOM INSTRUCTION

TECHNICAL FIELD

The present invention deals broadly with the field of teaching and training aids for classroom instruction. More specifically, it relates to a modularized visual training aid for classroom instruction, especially music instruction.

BACKGROUND OF THE INVENTION

Teachers face numerous challenges in getting and keeping the interest of a classroom of people, especially children. These challenges are compounded when the teacher must move his or her equipment from space to space on a regular basis to serve the needs of children of a wide range of age and skill levels. Traditional blackboard or chalkboards are positioned too high to accommodate small children or a seated adult comfortably. In addition, traditional chalkboards or blackboards are not easily transported and lack storage space for materials beyond chalk and erasers.

Music teachers especially face the problems of presenting lessons in areas not designed for music teaching. Traditional classroom training aids frequently do not provide the music tools, especially the musical staff notation that is essential to teaching music.

Many music teachers have become adept at adapting traditional chalkboards to their needs by using either chalkboards preprinted with musical notation or creating musical staffs with specialized five fingered chalk holders. However, it is difficult to prepare multiple lessons in advance as each lesson must be rewritten prior to its presentation. Also, many musical compositions are lengthy and require more bars than may clearly fit within the confines of a traditional chalkboard.

A teaching and training aid that would be easy to move yet stable around even young children, accommodate users either while seated or standing, provide ample storage for teaching tools and easily expandable display space would be greatly appreciated.

SUMMARY OF THE INVENTION

The present invention is a modularized visual training aid for classroom instruction. The visual training aid includes a base for stabilizing the training aid during transit and in-use, an upright support operably coupled to the base and extending generally vertically upward from the base for storing the teaching tools and a display housing pivotably mounted to the upright support. The display housing includes an expandable vertical display surface for exhibition and application of the teaching tools and is shiftable between an elevated position and a lowered position to accommodate users of different heights. Storage areas for various teaching tools such as pointers, pens, markers, magnetic musical notation are provided on the base and on the display housing. Storage for teaching tools, such as lesson placards, is provided with the upright support.

In operation, a teacher can prepare parts of the lesson in advance on the lesson placards or vertical display surface. The teacher then moves the training aid the presentation location and pivots the display housing into either an elevated or lowered position as desired. During the lesson, students or the teacher can illustrate points by writing on the erasable display surface or positioning the lesson placards on the display surface with clips.

It is one objective of the present invention to provide a mobile lesson center that is easily adaptable for use with students of various ages and skill levels.

Another objective of the present invention is to provide a large expandable lesson display workspace in a relatively compact, easy to move teaching aid.

A further objective of the present invention is to provide ample storage compartments for storage of teaching aids, such as writing tools and lesson placards before, during and after a lesson presentation.

A further objective of the present invention is to provide teachers with the ability to prepare their visual tools for lesson presentations in advance and to readily change the appearance of the display area without re-drawing or re-writing those visual messages during the presentation.

DETAILED DESCRIPTION OF THE DRAWINGS

Figure 1:
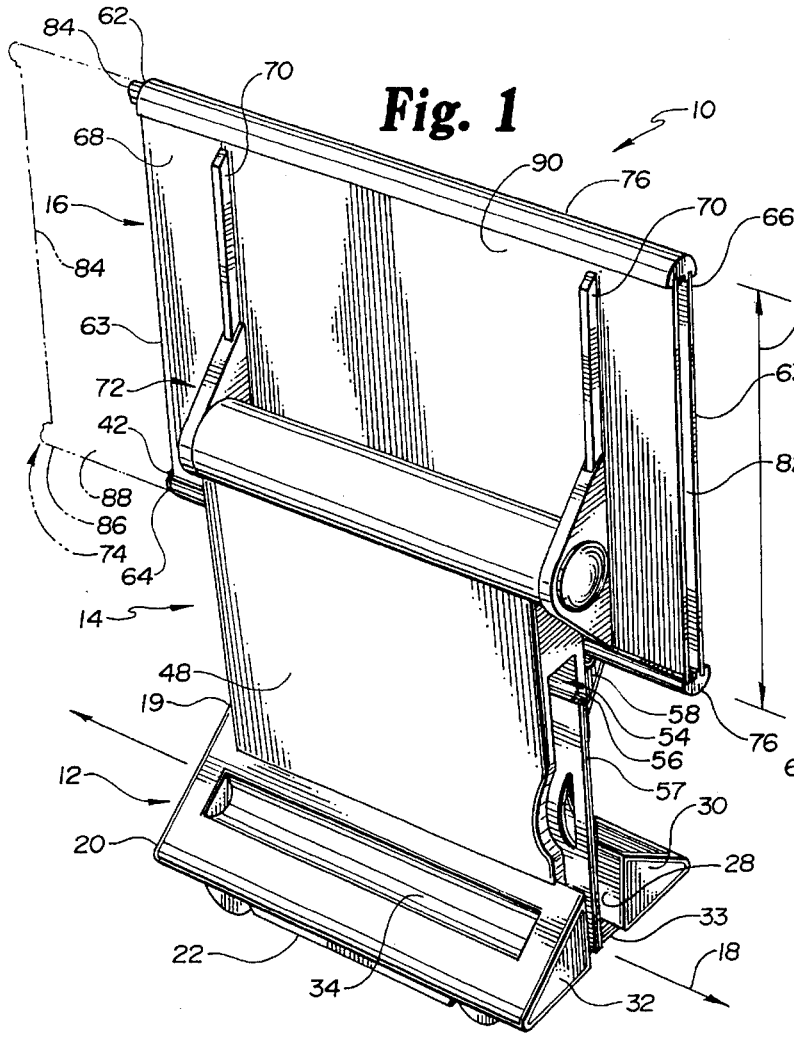
FIG. 1 is a perspective view of the modularized visual training aid for classroom instruction in accordance with the present invention in an elevated position.
Figure 8:
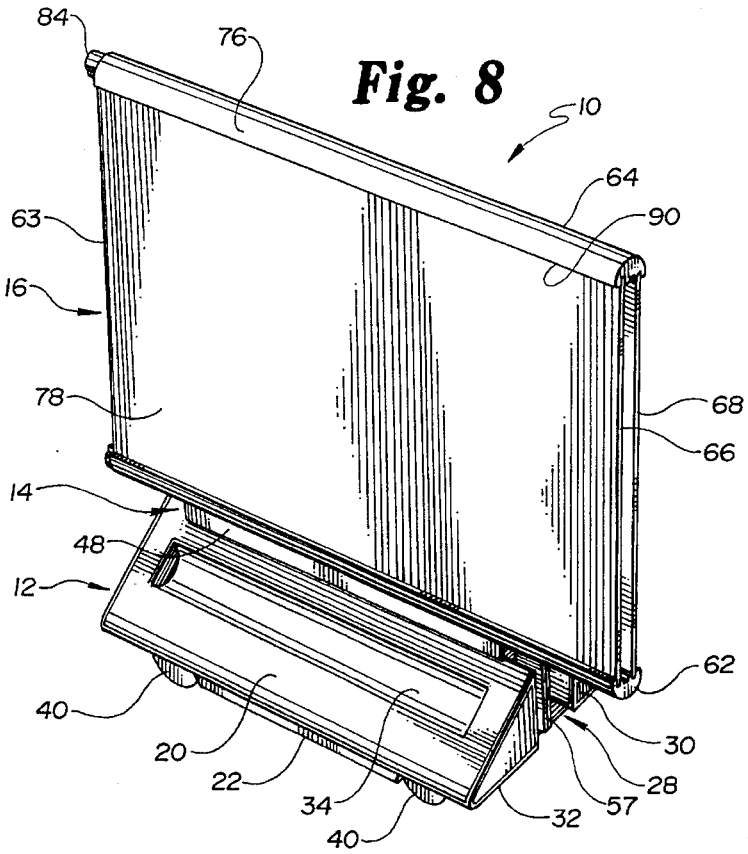
FIG. 8 is a perspective view of the visual training aid in accordance with the present invention in a lowered position.

Referring now to the drawings, wherein like reference numerals denote like elements throughout the several views, FIG. 1 illustrates a modularized visual training aid 10 in accordance with the present invention in an elevated position. FIG. 8 illustrates a modularized visual training aid 10 in accordance with the present invention in a lowered position. Referring to FIGS. 1 and 8, the training aid 10 broadly includes a base 12, upright support 14 and display housing 16.

The base 12 presents a longitudinal axis 18 along a line parallel to a center axis of the base 12 and slightly displaced from the center axis and an upper margin 19. The base 12 broadly includes an upper base 20 and lower base 22. In the preferred embodiment, the base 12 is weighted to provide stability.

Figure 2:
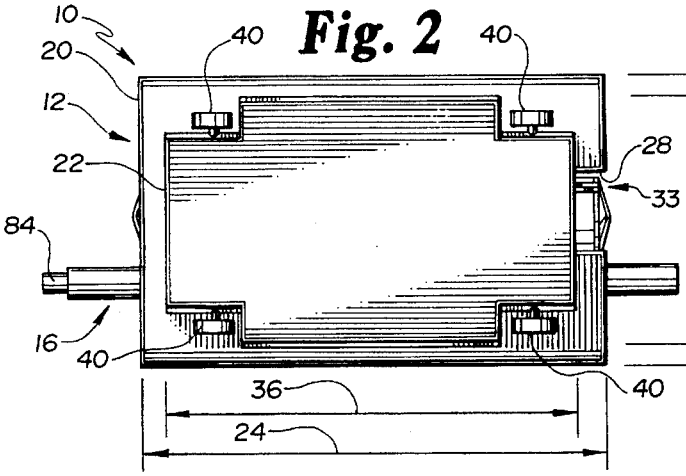
FIG. 2 is a bottom plan view thereof.

The upper base 20 is a generally triangular in cross section shape and, referring to FIG. 2, presents a characteristic upper base length 24 and width 26. The upper base 20 includes structure defining a slot 28 extending along the longitudinal axis 18 of the base 12 and opposed base wedges 30, 32. The slot 28 divides at least a portion of the upper base 20 into opposed base wedges 30, 32 and includes slot opening 33.

Each base wedge 30, 32 presents a generally triangular in cross section shape and is positioned generally parallel to the longitudinal axis 18. The base wedges 30, 32 are of unequal size due to the longitudinal axis 18 being slightly off-center. Each base wedge 30, 32 includes structure defining one or more grooves 34 extending generally parallel to the longitudinal axis 18 of the upper base 20. The grooves 34 are of sufficient size to hold a variety of teaching tools, such as pointers, markers or chalk.

Figure 9:
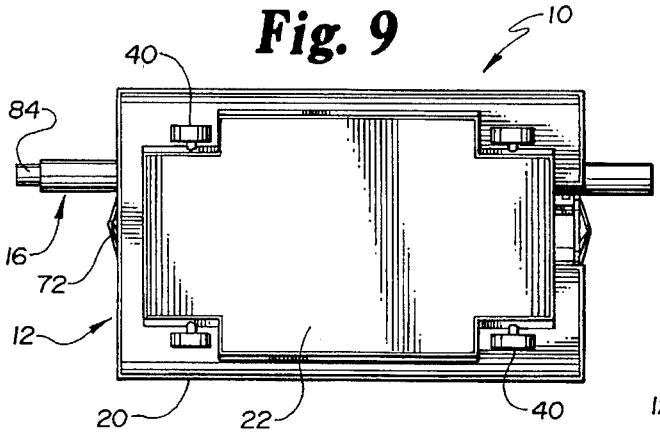
FIG. 9 is a bottom plan view of the visual training aid in its lowered position.

Referring to FIGS. 2 and 9, the lower base 22 presents a characteristic lower base length 36 and width 38 and includes a plurality of wheels 40. The surface of lower base 22 is a generally rectangular shape. The lower base length 36 is generally less than the upper base length 24 and the lower base width 38 is less than the upper base width 26. Two pair of opposed wheels 40 are operably coupled to the lower base 22 as is common in the art. In the preferred embodiment, the wheels 40 are dual wheel casters, such as an ITW 4 inch/100 mm twin wheel caster offered by Comtek Division of Waterbury, Conn.

Figure 5:
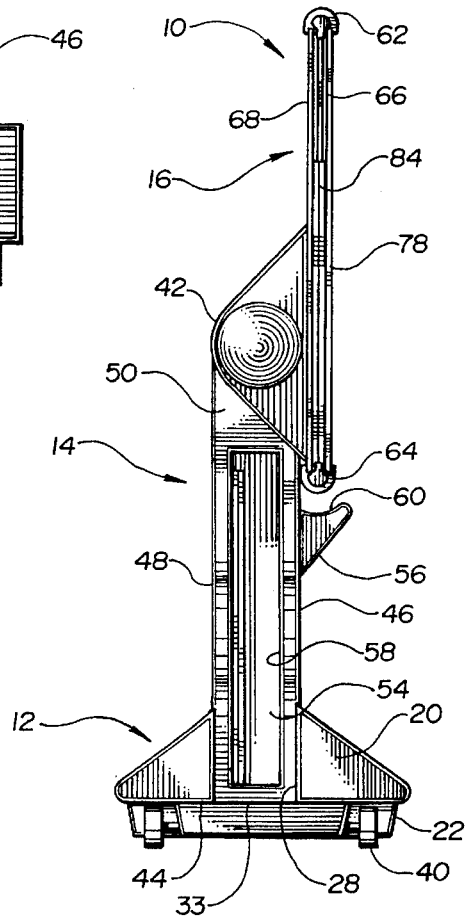
FIG. 5 is a right side elevational view thereof.
Figure 6:
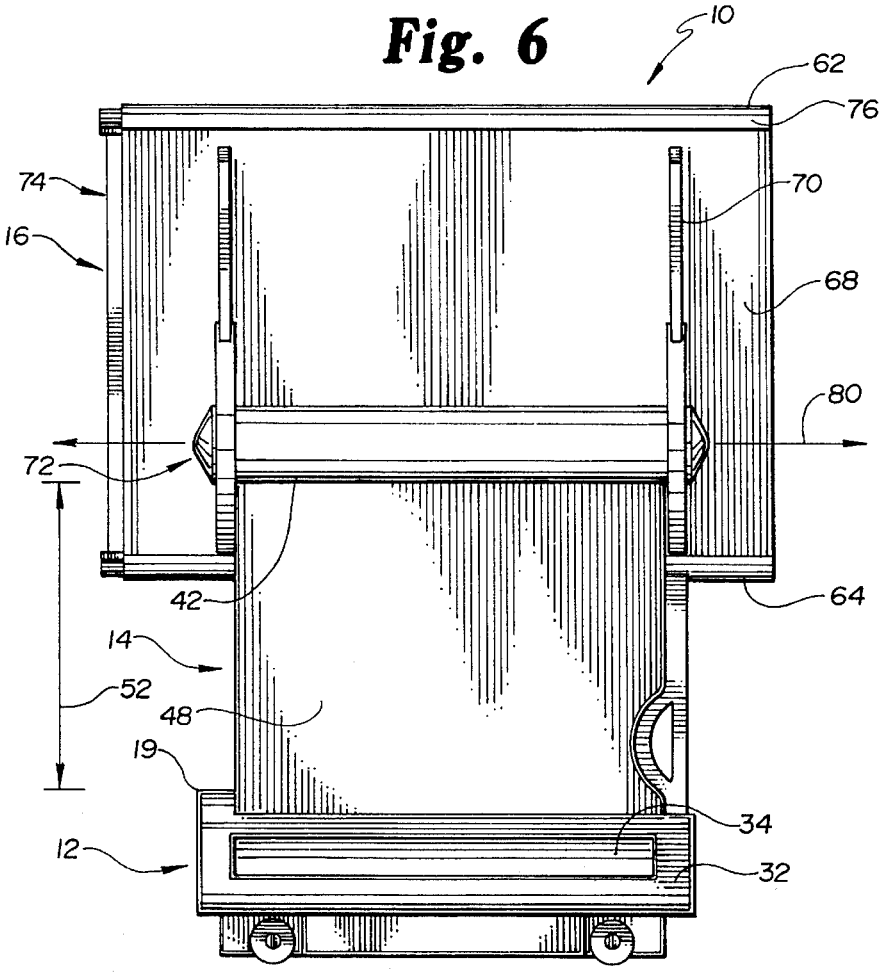
FIG. 6 is a rear elevational view thereof.
Figure 7:
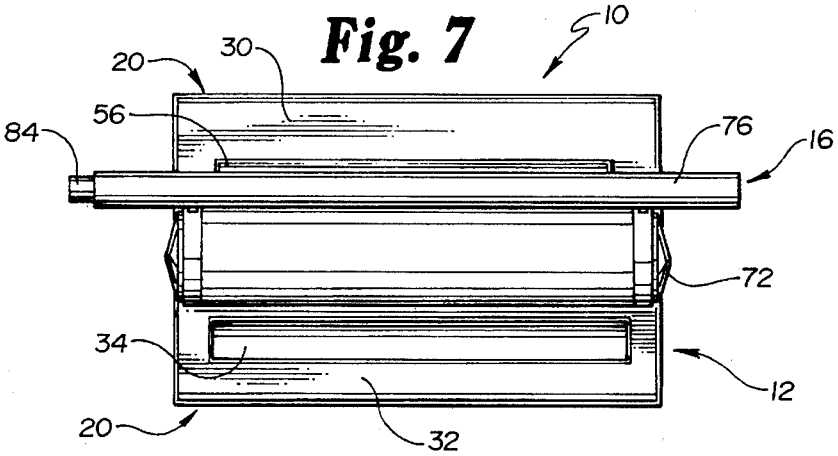
FIG. 7 is a top plan view thereof.
Figure 12:
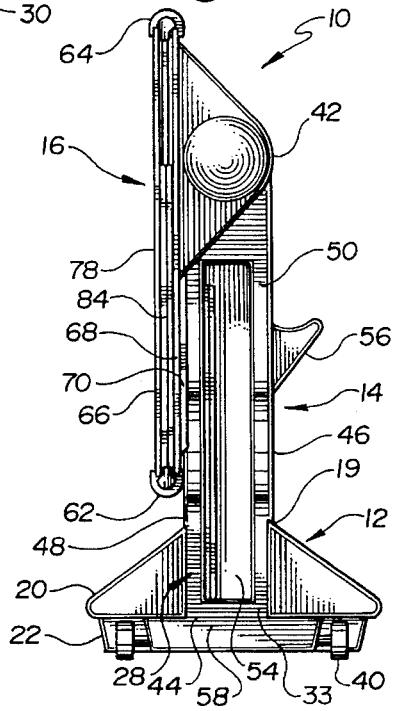
FIG. 12 is a right side elevational view of the visual training aid in its lowered position.

Referring to FIGS. 1, 3, 5, 6, 10 and 12, the upright support 14 carries a support upper margin 42, support lower margin 44 and presents a front face 46, rear face 48 and opposed side faces 50. The upright support 14 has a characteristic support height 52 from the base upper margin 19 to the support upper margin 42. The support height 52 is greater than the characteristic height 65 of the display housing 16. Referring to FIGS. 1, 5 and 12, the upright support 14 includes structure defining a generally rectangular in cross section storage compartment 54 and an tool holder 56. The upright support is operably coupled to the base 12 by securing the upright support 14 within the slot 28.

The storage compartment 54 includes a compartment opening 58 adjacent to the slot opening 33. The storage compartment is of sufficient size to hold a plurality of visual teaching tools, such as lesson placards 57.

Referring to FIGS. 3, 4, 10 and 11, in the preferred embodiment, the tool holder 56 extends along a substantial portion of the front face 46 of the upright support 14 generally parallel to the longitudinal axis 18 of the base 12. The tool holder 56 includes structure defining an indentation 60 of sufficient size to cradle a variety of teaching tools, such as pointers, pens, markers or chalk.

Referring to FIGS. 1, 4, 6, 8 and 13, the display housing 16 of the training aid 10 carries a top housing margin 62, bottom housing margin 64, side margins 63, and a characteristic housing height 65. The display housing 16 broadly includes a front panel 66, back panel 68, one or more strengthening ribs 70, a pivot mechanism 72, extension board system 74 and one or more clip members 76. The display housing 16 is operably coupled to the support upper margin 42 of the upright support 14 with the pivot mechanism 72 such that the display housing 16 is shiftable from the front face 46 of the upright support 14 to the rear face 48 of the upright support 14.

The front panel 66 presents vertical display surface 78. The vertical display surface 78 may be composed of one or more reusable, writable/erasable materials such as, for example, whiteboard or chalkboard. In the preferred embodiment, the vertical display surface 78 is composed of magnetized whiteboard. Those skilled in the art will understand that the display surface 78 or lesson placards 57 may be preprinted with musical staves to simplify musical instruction.

The back panel 68 is opposed to the front panel 66 and of generally equal size as the front panel 66. Strengthening ribs 70 are operably coupled to the back panel 68 and extend along the back panel 68. In the preferred embodiment, the ribs 70 are positioned adjacent to the pivot mechanism 72.

The pivot mechanism 72 is operably coupled to the back panel 68 of the display housing 16 and to the upright support 14 in a manner well-known in the art. The pivot mechanism 72 carries a pivot axis 80.

The pivot axis 80 is aligned above the longitudinal axis 18 of the base 12 and displaced from a line equidistant from the top housing margin 62 and bottom housing margin 64. The degree of displacement of the pivot axis 80 from a line equidistant from the top housing margin 62 and bottom housing margin 64 positions the pivot mechanism 72 adjacent to the bottom housing margin 64. The pivot mechanism 72 also includes a movement stabilizer (not shown), such as a compressed gas cylinder, as is well known in the art to minimize rapid jerky movements of a pivoting object.

Figure 3:
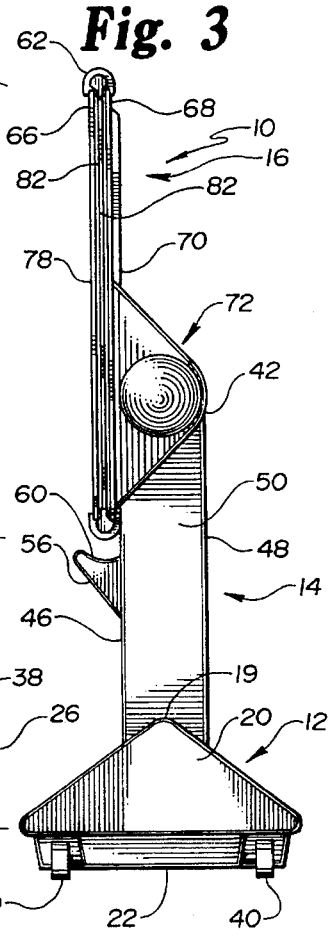
FIG. 3 is a left side elevational view thereof.
Figure 10:
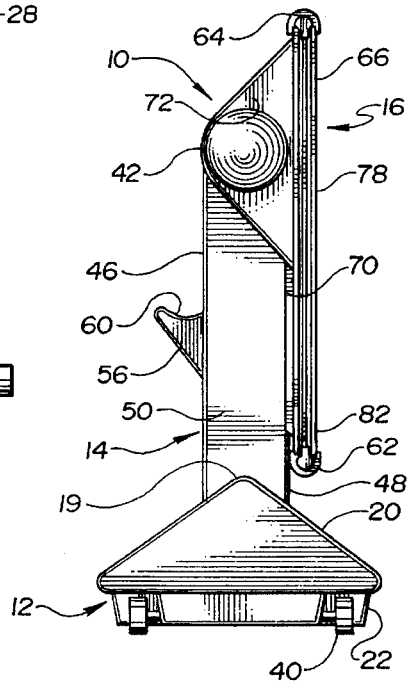
FIG. 10 is a left side elevational view of the visual training aid in its lowered position.
Figure 11:
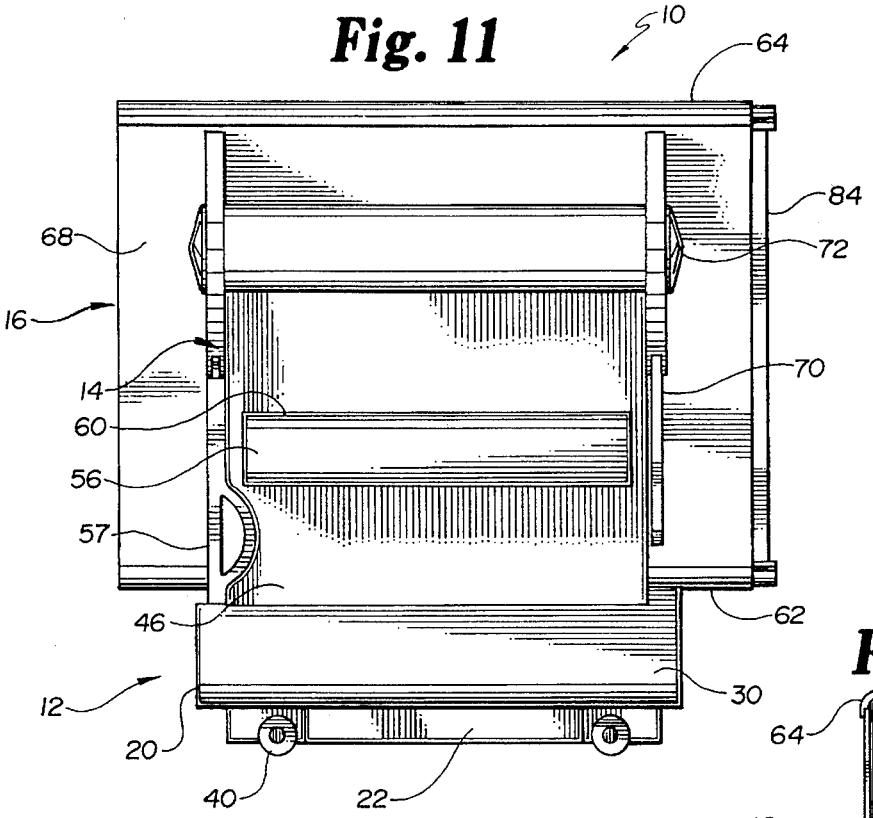
FIG. 11 is a front elevational view of the visual training aid in its lowered position.
Figure 13:
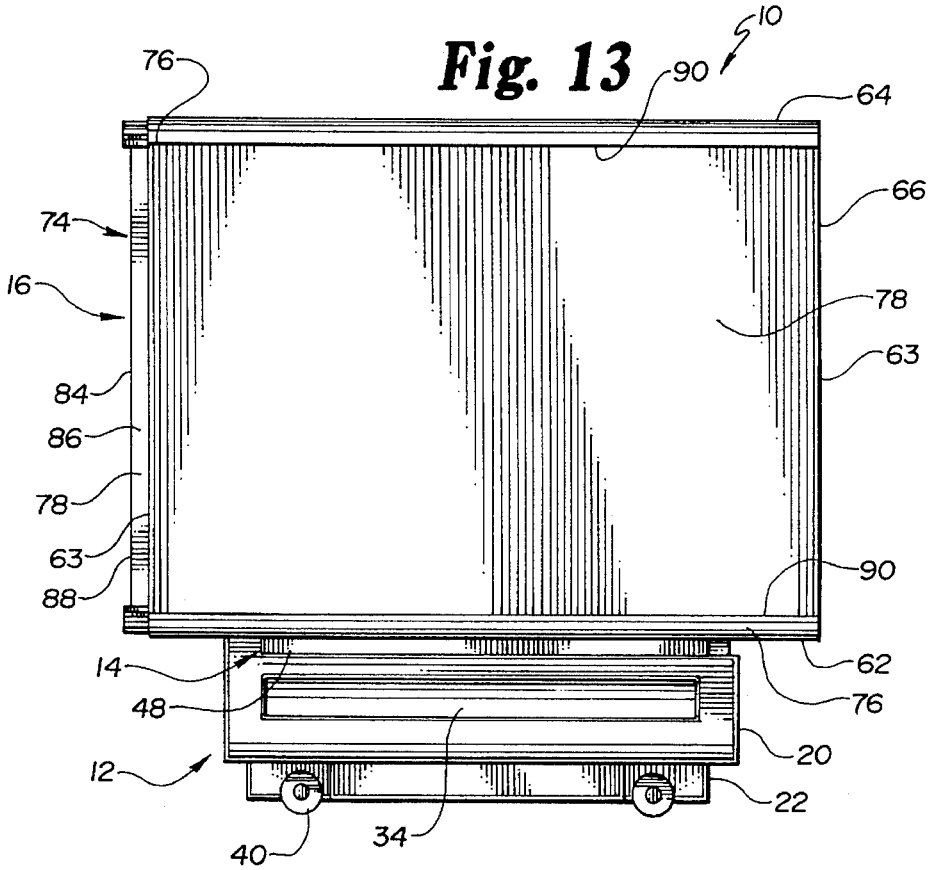
FIG. 13 is a rear elevational view of the visual training aid in its lowered position.
Figure 14:
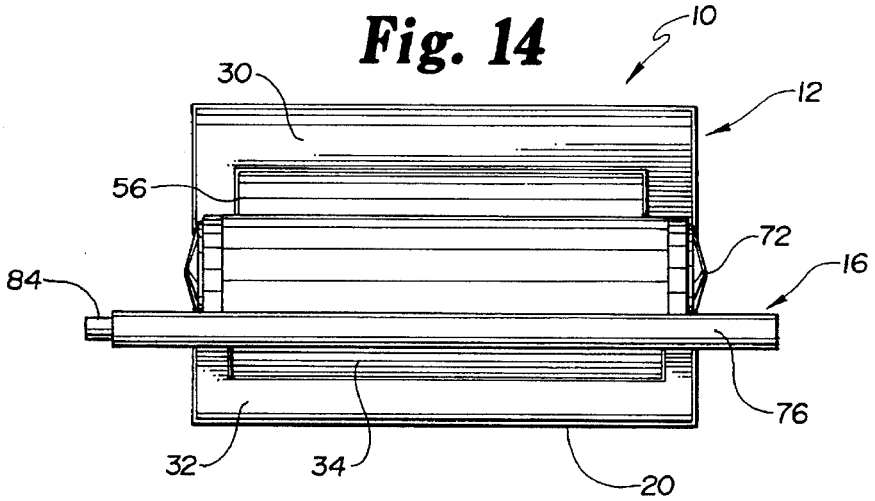
FIG. 14 is a top plan view of the visual training aid in its lowered position.

Referring to FIGS. 1, 3 and 10, the display housing 16 includes structure defining an extension cavity 82. The extension cavity 82 houses the extension board system 74. The extension board system 74 includes an extension board 84 and locking mechanism (not shown). Referring to FIGS. 1 and 13, the extension board 84 presents a front plane 86 and back plane 88. The front plane 86 carries a second vertical display surface 78.

Figure 4:
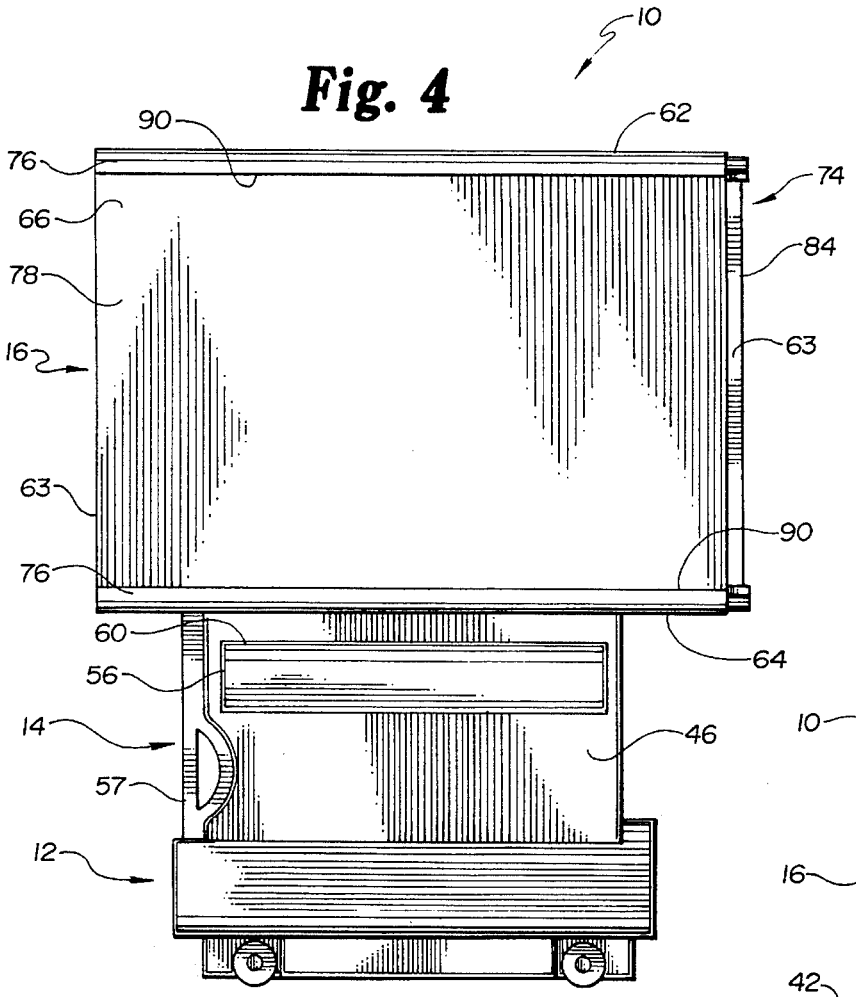
FIG. 4 is a front elevational view thereof.

Referring to FIGS. 4 and 13, one or more clip members 76 of the display housing 16 are coupled along the top housing margin 62 and bottom housing margin 64. The clip members 76 are formed of a half-arc of synthetic resin or other memory-retaining material and include a clip edge 90. The clip members 76 are positioned along the margins 62, 64 with the clip edge 90 flush against the front panel 66 of the display housing 16 in a snug fit. It will be understood by those skilled in the art that a variety of clip or holder mechanisms may be used, such as, for example, spring clips, magnets, removable adhesives and the like.

In operation, a teacher rolls the training aid 10 on the wheels 40 of the lower base 22 to the desired presentation location. Teaching tools, such as lesson placards, may be prepared in advance and stored in the storage compartment 54 of the upright support 14. Written lesson materials may also be prepared in advance on the vertical display surface 78 of both the front panel 66 and the extension board 84. Additional teaching tools such as magnetic music notation, chalk, erasable whiteboard markers and lesson pointers may be stored in the groove 34 of the base 12 or the tool holder 58 of the upright support 14.

The weight of the base 12 provides a counterweight to the weight of the upright support 14 and display housing 16 as the training aid 10 is moved. The dual wheel casters permit ease of movement in a variety of directions.

Once the training aid 10 is in the desired location, the teacher may pivot the display housing into either an elevated position or lowered position. To position the display housing 16 in an elevated position, the teacher pivots the display housing 16 so that the top housing margin 62 is upward and the display housing 16 is vertical. This positions the vertical display space 78 outward toward the classroom. The back panel 68 of the display housing 16 is flush against the front face 46 of the upright support 14. The tool holder 58 now is below the bottom housing margin 64 to provide for easy access to the teaching tools stored therein. The weight of the display housing 16 in an elevated position is countered by the weight of the base 12 and the weight and position of the upright support 14 along the off-center longitudinal axis 18 of the base 12.

The shape of the base 12 provides great stability over a relatively small area thus allows the teacher or student to approach the vertical display surface 78 without having to reach over a large counter-balancing base.

To position the display housing 16 in the lowered position, the teacher pivots the display housing 16 so that the top housing margin 62 is downward and the display housing 16 is vertical. Again, this positions the vertical display space 78 outward toward the classroom. The back panel 68 of the display housing 16 is flush against the rear face 48 of the upright support 14. The groove 34 now is below the top housing margin 62 to provide for easy access to the teaching tools stored therein. The weight of the display housing 16 in a lowered position is countered by the weight of the base 12 and the weight and position of the upright support 14 along the off-center longitudinal axis 18 of the base 12 positioning the display housing in a lowered position makes the vertical display surface 78 easily accessible to small children or to a seated adult.

The teacher may expand the vertical display surface 78 by use of the extension board 84. To position the extension board 84 in an in-use position, the extension board is pulled outward from the side margin 63 of the display housing 16 and secured in position by the locking mechanism. Positioning the extension board 84 adjacent to the front panel 66 of the display housing 16 increases the vertical display surface 78 by the area of the front plane 86 of the extension board 84. To place the extension board 84 in a storage position, the extension board 84 is retracted into the extension cavity 82.

Lesson placards 57 stored in the storage compartment 54 are removed for display from the compartment opening 56. The placards 57 may be rested against the base 12 or positioned against the front panel 66 of the display housing 14 with a clip member 76.

Use of the modularized visual training aid for classroom instruction in accordance with the present invention provides an effective apparatus for teachers to use to provide quick moving engaging lesson presentations to students of varying ages and skill levels.

Numerous characteristics and advantages of the invention have been set forth in the foregoing description. It will be understood, of course, that this disclosure is, in many respects, only illustrative. Changes can be made in details, particularly in the matters of shape, size and arrangement of parts without exceeding the scope of the invention. The invention scope is defined by the language by which the appendant claims are expressed.

We claim:

1. A visual training aid for classroom instruction, comprising:

a base adapted to rest on a generally planar surface;

an upright support operably coupled to, and extending generally vertically upward from said base;

a display housing; and a pivot mechanism presenting a generally horizontal pivot axis operably, pivotably coupling said display housing to said upright support, said display housing presenting at least one display surface, said display housing being pivotably shiftable about said horizontal pivot axis between a generally vertical elevated position and a generally vertical lowered position, said pivot mechanism including a display housing mounting bracket orienting said display housing in a spaced apart relationship with said pivot axis such that said display housing is positioned on one side of said pivot axis in said elevated position and on the opposite side of said pivot axis in said lowered position thereby stabilizing the display housing in both said elevated and said lowered positions.

2. The training aid of claim 1 wherein said base presents a longitudinal axis along a line parallel to a center axis of said base and slightly displaced from said center axis and further includes a generally triangular upper base and lower base operably coupled to said upper base, said upper base of a characteristic length less than that of a characteristic length of said display housing and including structure defining a slot extending along at least a portion of said longitudinal axis of said base for secure coupling to said upright support and opposed base wedges for counterbalancing the weight of said upright support and said display housing.

3. The training aid of claim 2 wherein said base wedge includes structure defining at least one groove extending generally parallel to said longitudinal axis of said base along at least a portion of said base wedge.

4. The training aid of claim 2 wherein said upper base presents a characteristic upper base length and a characteristic upper base width and said lower base presents a characteristic length less than said upper base length and a characteristic width less than said upper base width and further includes a plurality of wheel means for moving the training aid to desired locations.

5. The training aid of claim 4 wherein said wheel means include a plurality of opposed dual wheel casters.

6. The training aid of claim 2 wherein said base presents an upper margin and said display housing carries a characteristic housing height and said upright support presents a front face, rear face and opposed side faces and has a characteristic support height from said base upper margin to said support upper margin greater than said characteristic housing height of said display housing when said display housing is secured in said lowered position.

7. The training aid of claim 6 wherein said upright support further includes structure defining a generally rectangular storage compartment, said storage compartment including a compartment opening positioned at least partially within said base slot.

8. The training aid of claim 6 wherein said upright support further includes an implement holder extending along at least a portion of said front face of said upright support generally parallel to said longitudinal axis of said base and positioned below said display housing when said display housing is secured in said elevated position.

9. The training aid of claim 8 wherein said base and upright support are made of synthetic resin.

10. The training aid of claim 1 wherein said display housing further includes a front panel presenting said vertical display surface, a back panel opposed to said front panel and of generally equal size as said front panel, top housing margin, bottom housing margin, center line equidistant from said top housing margin and said bottom housing margin, at least one strengthening rib operably coupled to said back panel extending along a portion of said back panel, and a pivot mechanism operably coupled to said back panel adjacent to said bottom margin and including a pivot axis, said pivot axis generally parallel to said center line of said display housing and displaced from said center line toward said bottom margin whereby shifting said display housing around said pivot axis moves said display housing between said elevated position and said lowered position.

11. The training aid of claim 1 wherein said vertical display surface is composed of magnetic whiteboard.

12. The training aid of claim 1 wherein said vertical display surface is composed of chalkboard.

13. The training aid of claim 1 wherein said display housing further includes an extension board presenting a front plane and back plane and shiftable between an in-use position and a storage position, structure defining an extension cavity for storage of said extension board when said extension board is in said storage position and a locking mechanism, for securing said extension board in the extended position, adjacent to said display housing and extending outward from said display housing when said extension board is in said in-use position, whereby said vertical display surface of said aid is increased by the area of the front plane of said extension board.

14. The training aid of claim 1 wherein said display housing further includes at least one clip member for positioning teaching tools adjacent to said vertical display surface.

15. The training aid of claim 1, said display housing having first and second generally horizontal margins and presenting a display housing midline equidistant from said first and second horizontal margins, said horizontal pivot axis being vertically offset from said display housing midline when said display housing is in said generally vertical elevated and lowered positions.

* * * * *

UNITED STATES PATENT AND TRADEMARK OFFICE

CERTIFICATE OF CORRECTION

PATENT NO. : 5,501,603

DATED : March 26, 1996

INVENTOR(S) : Mueller et al.

It is certified that error appears in the above-identified patent and that said Letters Patent is hereby corrected as shown below:

In the Abstract, line 13, insert the word "to" between the words "moved" and "the".

Column 1, line 56, insert the word "and" between the words "markers," and "magnetic".

Column 1, line 62, insert a comma after the word "aid".

Column 3, line 32, delete the word "an" and substitute therefor --a--.

Signed and Sealed this

First Day of October, 1996

*Attest:*

Bruce Lehman

BRUCE LEHMAN

*Attesting Officer*

*Commissioner of Patents and Trademarks*